US010125968B2

(12) United States Patent
Zanotto et al.

(10) Patent No.: US 10,125,968 B2
(45) Date of Patent: Nov. 13, 2018

(54) METHOD OF PRODUCING LIGHTING DEVICES AND CORRESPONDING LIGHTING DEVICE

(71) Applicant: OSRAM GmbH, Munich (DE)

(72) Inventors: Alberto Zanotto, Padua (IT); Simone Massaro, Venice (IT); Thomas Rieger, Aufhausen (DE); Roberto Didone', Rosà (IT); Simon Bobbo, Mirano (IT); Lorenzo Baldo, Giavera del Montello (IT)

(73) Assignee: OSRAM GmbH, Munich (DE)

( * ) Notice: Subject to any disclaimer, the term of this patent is extended or adjusted under 35 U.S.C. 154(b) by 5 days.

(21) Appl. No.: 15/409,589

(22) Filed: Jan. 19, 2017

(65) Prior Publication Data

US 2017/0205065 A1 Jul. 20, 2017

(30) Foreign Application Priority Data

Jan. 20, 2016 (IT) ..... 102016000005130

(51) Int. Cl.
*F21S 4/00* (2016.01)
*F21V 31/04* (2006.01)
(Continued)

(52) U.S. Cl.
CPC ..... *F21V 31/04* (2013.01); *F21S 4/24* (2016.01); *F21S 4/28* (2016.01); *F21V 3/00* (2013.01);
(Continued)

(58) Field of Classification Search
CPC ... F21V 31/04; F21V 4/24; F21V 4/28; F21V 3/00; F21V 3/02; F21V 7/0016;
(Continued)

(56) References Cited

U.S. PATENT DOCUMENTS 6,158,882 A 12/2000 Bischoff, Jr.
7,562,998 B1 * 7/2009 Yen ..... F21K 9/27 362/219
(Continued)

FOREIGN PATENT DOCUMENTS

DE 102007053545 A1 4/2009
EP 1691131 A1 8/2006
(Continued)

OTHER PUBLICATIONS

European Search Report based on application No. 16 20 7222.7 (9 pages) dated May 4, 2017 (Reference Purpose Only).
(Continued)

*Primary Examiner* — Bryon T Gyllstrom
(74) *Attorney, Agent, or Firm* — Viering, Jentschura & Partner mbB

(57) ABSTRACT

A lighting device may be produced by providing a protected elongate light emitting module, including a substrate with at least one electrically-powered light radiation source, and at least one sealing mass protecting light radiation source(s), and by coupling to said light emitting module a channel-shaped cover member with a body portion including light permeable material and side portions, with the side portions of the cover member embracing and locking therebetween the light emitting module and with light radiation source(s) facing towards body portion of cover member, whereby the light permeable material provides a propagation path for the light radiation from light radiation source(s).

10 Claims, 5 Drawing Sheets

(51) Int. Cl.

| | |
|---|---|
| ***F21S 4/24*** | (2016.01) |
| ***F21V 3/02*** | (2006.01) |
| ***F21V 17/10*** | (2006.01) |
| ***F21V 19/00*** | (2006.01) |
| ***F21V 3/00*** | (2015.01) |
| ***F21V 7/00*** | (2006.01) |
| ***F21V 17/16*** | (2006.01) |
| ***F21S 4/28*** | (2016.01) |
| *F21Y 103/10* | (2016.01) |
| *F21Y 115/10* | (2016.01) |
| *F21Y 107/70* | (2016.01) |

(52) U.S. Cl.
CPC ..... *F21V 3/02* (2013.01); *F21V 7/005* (2013.01); *F21V 7/0016* (2013.01); *F21V 17/101* (2013.01); *F21V 17/164* (2013.01); *F21V 19/002* (2013.01); *F21Y 2103/10* (2016.08); *F21Y 2107/70* (2016.08); *F21Y 2115/10* (2016.08)

(58) Field of Classification Search
CPC ..... F21V 7/005; F21V 17/101; F21V 17/164; F21V 19/002
USPC ..... 362/223
See application file for complete search history.

(56) References Cited

U.S. PATENT DOCUMENTS 7,611,260 B1* 11/2009 Lin ..... F21K 9/00 362/217.01
2003/0218879 A1* 11/2003 Tieszen ..... F21V 21/088 362/235
2005/0152146 A1* 7/2005 Owen ..... A61L 2/10 362/294
2005/0276066 A1* 12/2005 Kim ..... G02F 1/133603 362/561
2007/0263385 A1* 11/2007 Fan ..... G09F 13/22 362/249.16
2009/0219713 A1* 9/2009 Siemiet ..... F21V 3/02 362/218
2010/0061095 A1* 3/2010 Hoffmann ..... F21S 8/022 362/235
2010/0220476 A1* 9/2010 Kuo ..... F21K 9/27 362/235
2010/0265693 A1* 10/2010 Ryu ..... F21V 5/04 362/84
2012/0106144 A1* 5/2012 Chang ..... F21K 9/17 362/218
2012/0236533 A1* 9/2012 Nakamura ..... F21V 3/0427 362/84
2013/0083524 A1* 4/2013 Devorris ..... F21V 31/04 362/235
2013/0308338 A1* 11/2013 Lin ..... F21V 9/30 362/609
2013/0335944 A1 12/2013 Battis et al.
2014/0126193 A1 5/2014 Dixon et al.

FOREIGN PATENT DOCUMENTS

| | | | |
|---|---|---|---|
| EP | 2541288 | A1 | 1/2013 |
| EP | 3106742 | A1 | 12/2016 |
| WO | 2009026284 | A2 | 2/2009 |
| WO | 2015169697 | A1 | 11/2015 |

OTHER PUBLICATIONS

Italian Search Report based on application No. 102016000005130 (5 pages and 2 pages of English translation) dated Aug. 11, 2016 (Reference Purpose Only).

* cited by examiner

METHOD OF PRODUCING LIGHTING DEVICES AND CORRESPONDING LIGHTING DEVICE

CROSS-REFERENCE TO RELATED APPLICATION

This application claims priority to Italian Patent Application Serial No. 102016000005130, which was filed Jan. 20, 2016, and is incorporated herein by reference in its entirety.

TECHNICAL FIELD

Various embodiments relate generally to lighting devices.

One or more embodiments may refer to lighting devices employing electrically-powered light radiation sources such as solid-state light radiation sources, e.g. LED sources.

BACKGROUND

Lighting devices are currently available which are comprised of flexible linear modules employing LED light radiation sources. Such modules, which may be exhibit e.g. with a ribbon-like shape, may be available in two versions, either as protected or as unprotected modules. Unprotected modules may be used indoors, e.g. for the lighting of rooms, in conditions which do not require a protection against foreign matter penetration. On the contrary, protected modules may provide such a protection, e.g. an IP protection degree, and therefore they may be used both for indoor and outdoor applications.

In order to produce such modules, especially in the protected version, various different solutions may be resorted to, such as extrusion, co-extrusion, deposition of sealing mass (potting) etc. Such modules, especially protected modules, may be produced with different shapes and features, so that they may fit to a wide range of possible applications. This may be true e.g. for the light emitting areas/surfaces and the possible light radiation distribution arrangements, the possibility being given of improving optical performances and mechanical and electrical reliability, while supporting the achievement of a given protection degree (e.g. IP protection degree).

This may involve an increase of production complexity at different levels. For example, in order to change the optical properties of protected modules, light engines may be employed having different LEDs and/or optical accessories, therefore requiring different designs and production steps which may require a change of the manufacturing parameters.

SUMMARY

One or more embodiments aim at providing improved solutions, e.g. as regards the possibility of changing the external shape and/or the emitting area of a protected module, while preserving the same design of the e.g. LED light engine.

One or more embodiments may also concern a corresponding lighting device.

One or more embodiments enable to achieve one or more of the following advantages:

possibility of changing the shape and/or the optical properties of a protected module, so as to simplify the fitting to the final application, specifically by modifying a component used as cover, while the basic module remains unchanged; this leads to advantages consisting e.g. in the reduction of changes in manufacturing;

possibility of implementing such cover in a wide range of different shapes and using different materials, the possibility being given of increasing the product portfolio;

achievement of the desired protection degree (e.g. IP degree) independently of the cover, because it is already contained in the basic module;

mechanical robustness and reliability of the protected module, guaranteed by the shape of the cover, adapted to include arms embracing the basic module with sufficient firmness;

possibility of further increasing the mechanical robustness and the reliability of the protected module, e.g. via laminating operations for the coupling between the basic module and the covering embracing it: e.g. a glue may be used as an interface material, which absorbs mechanical stresses which may arise between the two components if the module is bent.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DETAILED DESCRIPTION

Figure 1:
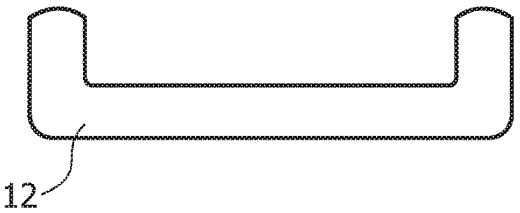
FIGS. 1 to 3 show subsequent steps of the production of a component which may be employed in one or more embodiments.

In the following description, numerous specific details are given in order to provide a thorough understanding of various exemplary embodiments. The embodiments may be practiced without one or several of the specific details, or with other methods, components, materials, etc. In other instances, well-known structures, materials, or operations are not shown or described in detail to avoid obscuring the various aspects of the embodiments.

Reference throughout this specification to "one embodiment" or "an embodiment" means that a particular feature, structure, or characteristic described in connection with the embodiment is included in at least one embodiment. Thus, the possible appearances of the phrases "in one embodiment" or "in an embodiment" in various places throughout this specification are not necessarily all referring exactly to the same embodiment. Furthermore, particular features, structures, or characteristics may be combined in any suitable manner in one or more embodiments.

The headings provided herein are given for convenience only, and therefore do not interpret the extent of protection or the scope of the embodiments.

The Figures show a lighting device adapted to include, in one or more embodiments:

a basic module (or light engine), denoted as 10, and a member 110, adapted to be coupled as a cover to basic component 10.

In one or more embodiments, both component 10 and cover member 110 (which in the following will simply be named "cover" for the sake of brevity) may have an overall elongate, e.g. ribbon-like, shape, with optional flexibility features.

Components 10 and 110 may therefore be considered as being of indefinite length, so that they may be optionally cut to measure to achieve the length suitable to the application needs.

In one or more embodiments, module 10 may be obtained from an elongate, e.g. channel-shaped, support 12, including e.g. at least one material as silicone. In one or more embodiments, support 12 may be produced e.g. by extrusion.

In one or more embodiments, support 10 may contain a light radiation emitting assembly, e.g. of the kind named Flexible Printed Circuit Assembly, i.e. FPCA.

Figure 2:
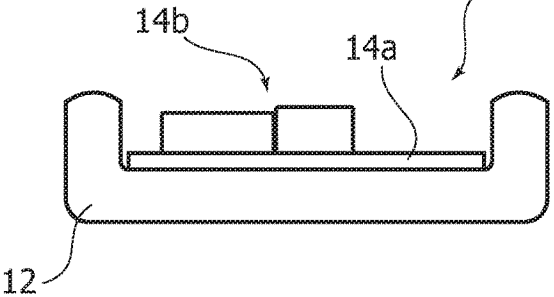

Such an assembly, denoted on the whole as 14 in FIG. 2, may include a laminar substrate 14*a* substantially comparable to a Printed Circuit Board (PCB), carrying one or more electrically-powered light radiation sources.

In one or more embodiments, such sources may be solid-state light radiation sources, e.g. LED sources, 14*b*, optionally associated with corresponding supply and/or driving electronic circuits.

The structure exemplified in FIG. 2 may be implemented e.g. by laminating the FPCA 14 onto support 12.

Thereafter, a material including e.g. one or more layers of silicone material may be applied (e.g. by potting) onto support 12.

Figure 3:
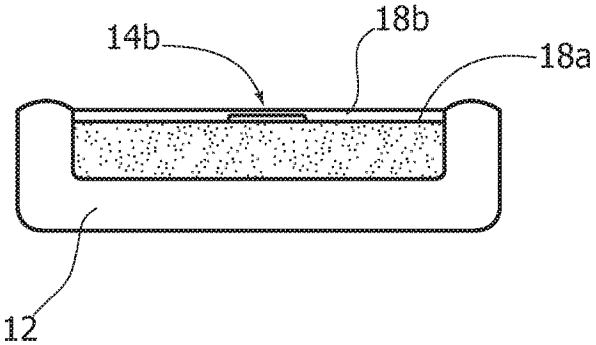
Figure 4:
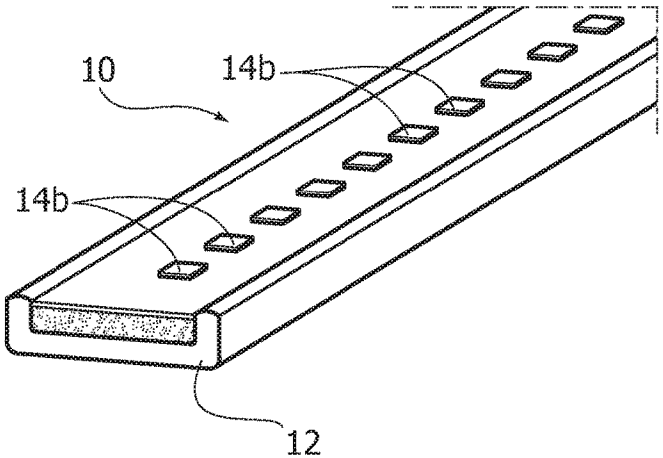
FIG. 4 is a perspective view of a component which may be produced with the steps of FIGS. 1 to 3.

FIG. 3 shows as an example a solution wherein a first layer 18*a* of an at least partially light-impermeable material (e.g. a translucent material) is deposited within support 12, embedding the LEDs and the respective associated electronic devices (denoted on the whole as 14*b*), so that such components are masked (and therefore not visible) from the outside, except for the light radiation emitting surfaces of the LEDs.

Over layer 18*a*, a further layer 18*b* may be applied of a light-permeable (e.g. transparent) material, adapted to be traversed by the light radiation emitted by the emitting surfaces of sources 14*b*.

In one or more embodiments, the material of layer 18*b* may be light-reflective (e.g. including a white material), so as to perform said masking action while simultaneously exerting a reflective action on the light radiation, so as to enhance the light radiation "recycling" effect and to increase the efficiency of the light radiation emission.

In one or more embodiments, the component which herein is named "cover" 110 for brevity may have the shape of an elongate profiled body, e.g. with a channel-shaped cross-section profile.

Figure 5:
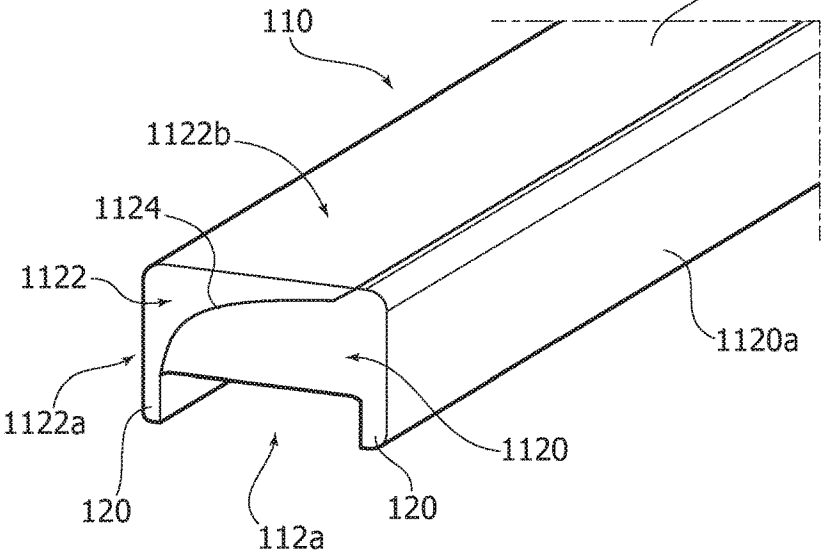
FIG. 5 shows another component which may be employed in one or more embodiments.

For example, in embodiments as exemplified in FIG. 5 and the subsequent Figures, cover 110 may include a body portion 112 and two side portions 120 adapted to be obtained e.g. in a single (co-extrusion) process, employing one or more flexible materials such as silicone or TPE.

In one or more embodiments, cover 110 may be comprised of one single material, adapted to exhibit features such as a particular colour (including e.g. coloured silicone) and/or diffusivity (including e.g. diffusive silicone filled with alumina—$Al_2O_3$—particles) and/or transparency (including e.g. a transparent silicone), such features being adapted to be optionally combined e.g. in different parts of cover 110.

In one or more embodiments, the features of cover 110 may therefore be chosen at will, as regards e.g. materials, shapes, optical properties, etc., depending on the application needs.

In one or more embodiments, cover 110 may be coupled to module 10 (which, as previously stated, may be implemented as a "protected" module according to the above-mentioned criteria) e.g. by lamination.

In one or more embodiments, between module 10 and cover 110 it is possible to interpose a glue and/or silicone layer acting as an interface (e.g. being adapted to absorb mechanical stresses which may arise between both components 10, 110 if they are bent).

As previously stated, in one or more embodiments, both basic module 10 and cover 110 may therefore be implemented as components exhibiting flexibility, e.g. in the up/down or in the right/left direction from the viewpoint of FIGS. 5 to 10 and 11A to 11C.

In one or more embodiments, the production process may be further simplified by using, as an interface material (not visible in the Figures), a material similar to the sealing mass for layers 18*a*, 18*b*, in order to impart the features of a protected module to basic module 10.

Figure 6:
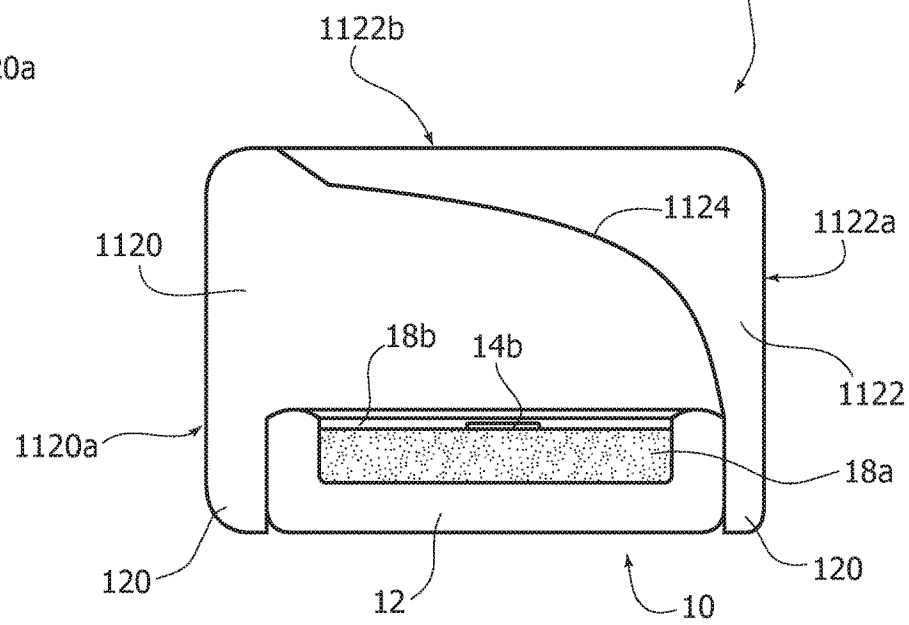
FIG. 6 is a cross-sectional view of a lighting device which may be produced according to one or more embodiments.

FIG. 6 shows possible coupling options between basic module 10 and cover 110.

Said Figure (as well as FIGS. 5, 7 to 10 and 11A to 11C) shows that, in one or more embodiments, the central portion of cover 110 may include a mouth portion 112*a*, located internally between side portions 120, which protrude from central portion 112. Said mouth portion 112*a* may therefore have an overall concave shape, the concavity facing outwardly of the channel shape of profiled body 112, 120 of cover 110, so as to receive module 10.

In one or more embodiments, basic module 10 may be coupled to cover 110 with the light radiation source(s) 14*b* (e.g. carried by FPCA 14) facing towards body portion 112 of cover 110.

In this way, in use, the light radiation emitted by source(s) 14*b* may be directed towards said central portion 112. If it is made of a light-permeable material (optionally having coloured or diffusive features, depending on the application needs), central portion 112 of cover 110 may allow said light radiation to be emitted from lighting device 10, 110 at the face of cover 110 opposed to mouth portion 12*a* (i.e. upwards, from the viewpoint of FIGS. 5 to 10 and 11A to 11C).

In one or more embodiments, as exemplified in FIGS. 5 to 10, the profiled body of cover 110 may include (at least) two portions which may be obtained e.g. by extrusion, that is:

a portion 1120 of a material permeable to light radiation (i.e. transparent, and optionally coloured or diffusive on the basis of the application needs), and a portion 1122 of a material impermeable to light radiation (e.g. opaque, white).

In one or more embodiments, portions 1120 and 1122 may include materials equal or similar to those previously mentioned. These may therefore include polymer materials, such as silicone, the possibility being given of determining and adjusting the light permeability/impermeability value (transparency/opacity) by adjusting the quantity of a filler material, e.g. alumina.

In one or more embodiments, the light-impermeable (opaque) portion 1122 may be used to direct the light radiation of source(s) 14*b* towards the light-permeable (transparent) portion 1120.

In one or more embodiments, both portions 1120 and 1122 may have an interface surface (exemplified in FIGS. 5 to 10 by line 1124) adapted to extend in a direction which is at least approximately diagonal with reference to the profile of cover 110. Moreover, the interface surface 1124 between both portions 1120 and 1122 may have a (e.g. curved) profile which may be chosen according to the application needs.

As exemplified in FIGS. 5 to 10, in one or more embodiments, light-permeable (e.g. transparent) portion 1120 may include, at least for a substantial part, mouth portion 112*a* of cover 110, as well as a first side wall 1120*a* thereof.

On the other hand, portion 1122 may embrace the opposite side wall, denoted as 1122*a*, as well as the bottom or core wall 1122*b* of cover 110.

The relative position of both portions 1120, 1122 may anyway be different, e.g. the position shown in FIGS. 5 to 10 may be reversed.

In one or more embodiments, cover 110 may therefore have a side (exemplified herein by mouth portion 112*a*) which is free and hosts basic module 10, where therefore the light radiation is generated. Moreover, portion 1122 (interface surface 1124), thanks to the at least partially reflective (e.g. white) material thereof, is adapted to cooperate in sending the light radiation generated by source(s) 14*b* back to side surface 1120*a*, which acts as light radiation emitting surface.

In one or more embodiments, the fitting and/or the coupling of cover 110 to basic module 10 may be made easier by the side portions 120 of cover 110, which "embrace" basic module 10 and lock it therebetween, therefore contributing to retain cover 110 on basic module 10. For example, as side portions 120 of cover 110 lock basic module 10 therebetween, the position of the latter may be securely held during the coupling operation (e.g. by lamination), such a retention function being adapted to be performed also in a subsequent step.

In one or more embodiments, as exemplified in FIGS. 7 to 10, the coupling between side portions 120 and basic module 10 (whereof only support 12 is shown in some Figures, in order not to overburden the drawing) may be achieved by various form fitting arrangements.

Figure 8:
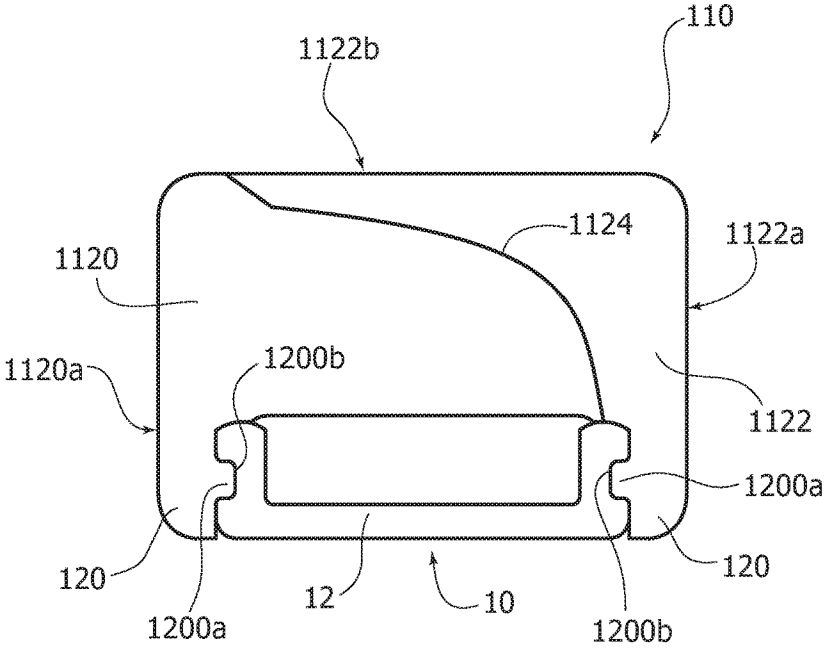
FIGS. 7 to 10 show possible different implementations of embodiments.
Figure 7:
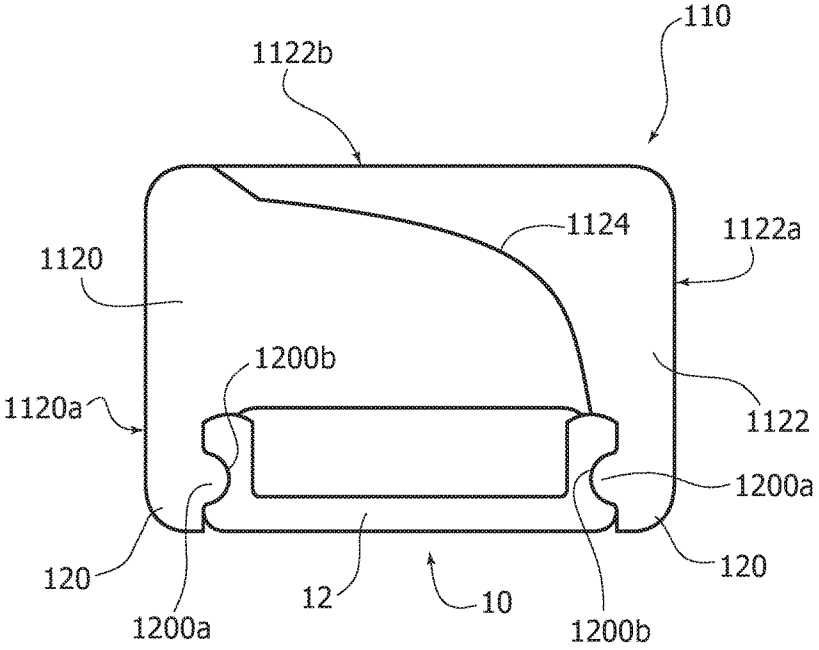

For example, as exemplified in FIGS. 7 and 8, side portions 120 may have protruding ribs 1200*a* which engage corresponding grooves 1200*b* in the side walls of support 12; in one or more embodiments, the arrangement may also be reversed (ribs on support 12 and grooves in side portions 120).

FIG. 8 exemplifies the possibility of shaping ribs 1200*a* and grooves 1200*b* (wherever they may be located) with an approximately square cross-section profile, which may enhance the retention force between basic module 10 and cover 110 during (and after) coupling.

Figure 10:
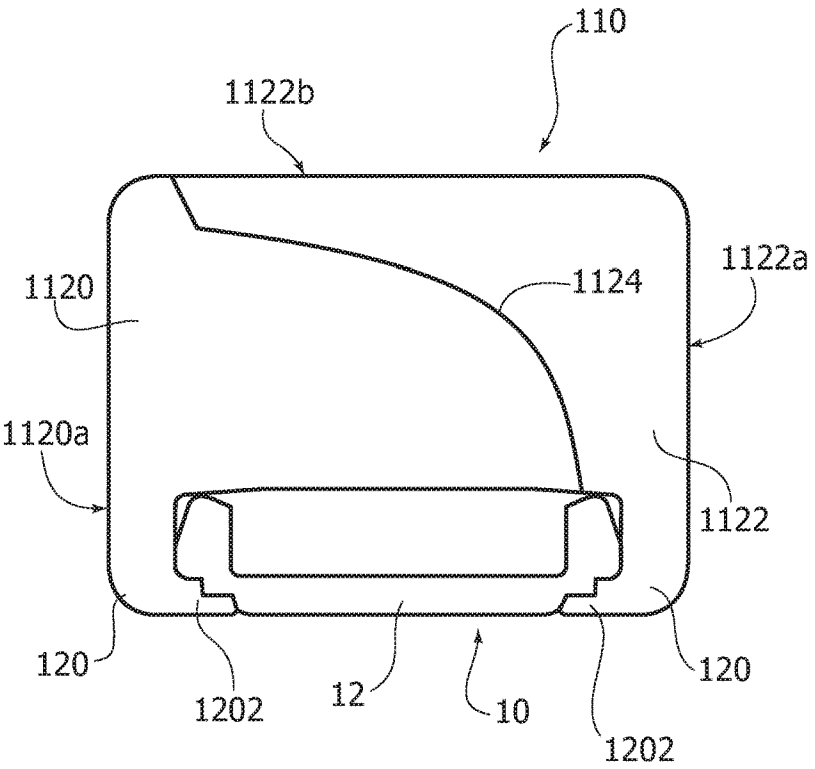
Figure 9:
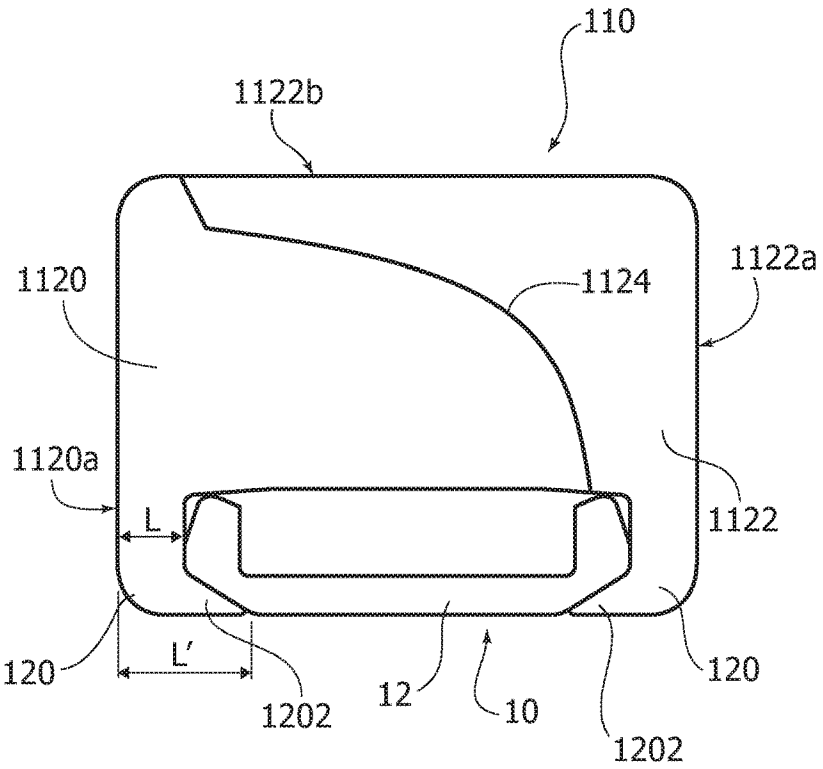

In one or more embodiments, as exemplified in FIGS. 9 and 10, side portions 120 may have distal portions 1202, e.g. with an (approximately) triangular cross-section profile, adapted to exert a hook action on basic module 10.

For example, in one or more embodiments said distal hook formations 1202 may have a length (denoted as L' in FIG. 9) higher than or equal to twice the corresponding dimension, i.e. the thickness (L in FIG. 9) of side portions 120 of cover 110: in other words, $L' \geq 2L$.

In one or more embodiments, as exemplified in FIG. 10, such a design may be further developed if said distal hook formations 1202 have a step-like profile, which may correspond to a related complementary sculpturing in the area of the connection between core wall and side walls of support 12 of basic module 10. Said arrangement has been found to further enhance the retention force established between basic module 10 and cover 110.

Figure 11A:
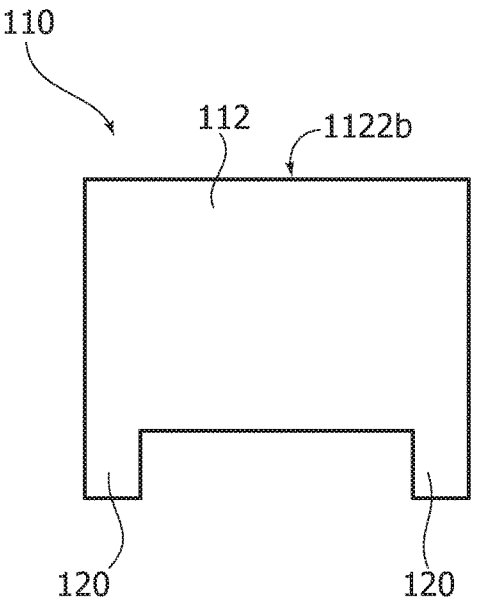
FIGS. 11A to 11C show possible different implementations of embodiments.
Figure 11B:
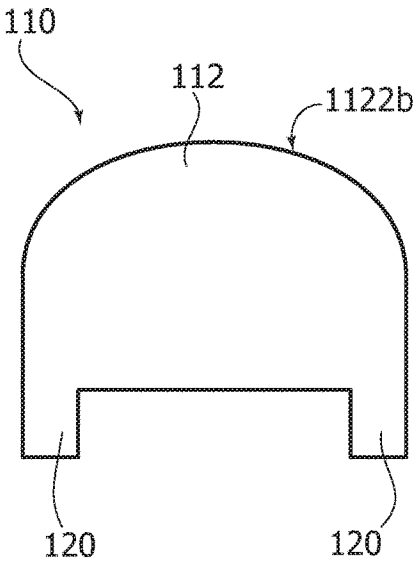
Figure 11C:
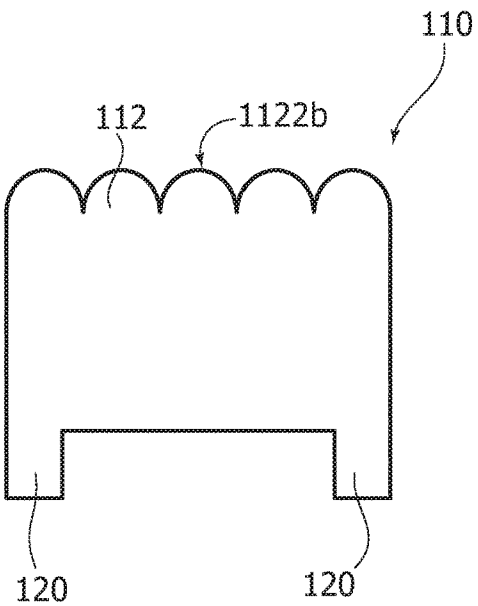

As exemplified in the schematic representations of FIGS. 11A to 11C, in one or more embodiments the outer surface 1122*b* of body 112 of cover 110 may have, instead of the flat shape exemplified in FIG. 11A, a curved tile-like shape (e.g. acting as a lens, as exemplified in FIG. 11B, or a sculpturing of bar-shaped or drop-shaped lens members (as exemplified in FIG. 11C).

Therefore, one or more embodiments lead to the production of a lighting device:

by providing an elongate light emitting module which is in itself protected, i.e. includes a substrate with at least one electrically-powered light radiation source, e.g. a LED source, and at least a sealing mass which protects the light radiation source(s), and by coupling said light emitting module with a channel-shaped cover member, having a body portion including a light-permeable material and side portions, the side portion of the cover embracing the light radiation module and locking it therebetween, with the light radiation source(s) facing towards the body portion of the cover member, so that the light-permeable material provides a propagation path for the light radiation from the light radiation source(s).

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

The invention claimed is:

1. A method of producing a lighting device, the method comprising:

providing an elongate light emitting module including a substrate with at least one electrically-powered radiation source and at least one sealing mass protecting said at least one light radiation source, and coupling to said light emitting module a channel-shaped cover member with a body portion including light permeable material and side portions, with said side portions of the cover member locking therebetween said light emitting module and with said at least one light radiation source facing towards said body portion of the cover member, whereby said light permeable material provides a propagation path for light radiation from said at least one light radiation source; and providing in said cover member a light-permeable portion facing towards said light emitting module and a light impermeable portion opposed to said light emitting module, to direct light radiation from said at least one radiation source laterally of said cover member.

2. The method of claim 1, wherein said coupling includes laminating said light emitting module onto said cover member.

3. The method of claim 1, further comprising providing an interface material between said light emitting module and said cover member.

4. The method of claim 1, further comprising coupling said light emitting module with said side portions of the cover member by means of complementary coupling formations.

5. The method of claim 4, wherein said complementary coupling formations include:

a rib and a groove to receive said rib provided on the one end the other of said side portions of the cover member and said light emitting module, or a distal hook formation of said side portions of the cover member embracing said light emitting module.

6. The method of claim 5, wherein said distal hook formation:

is provided with sculpturing, engaging the substrate of said light emitting module, and/or has a length no less than twice the thickness of said side portions of the cover member.

7. The method of claim 1, further comprising providing said light emitting module and said cover member as flexible elements.

8. The method of claim 1, further comprising providing said cover member with a lens-like surface opposed said light emitting module.

9. A lighting device, comprising:

an elongate light emitting module including a substrate with at least one electrically-powered radiation source and at least one sealing mass protecting said at least one light radiation source, and a channel-shaped cover member with a body portion including light permeable material and side portions, the cover member coupled to said light emitting module with said side portions of the cover member locking therebetween said light emitting module and with said at least one light radiation source facing towards said body portion of the cover member, whereby said light permeable material provides a propagation path for light radiation from said at least one light radiation source, wherein the cover member comprises a light-permeable portion facing towards said light emitting module and a light impermeable portion opposed to said light emitting module configured to direct light radiation from said at least one radiation source laterally of said cover member.

10. The method of claim 1, further comprising providing an interface surface between said light-permeable portion and said light-impermeable portion of said cover member.

* * * * *